US012384605B2

(12) United States Patent
Xu

(10) Patent No.: US 12,384,605 B2
(45) Date of Patent: Aug. 12, 2025

(54) LOCK CATCH STRUCTURE AND STORAGE BOX OF CHESS PIECES

(71) Applicant: A&A INTELLIGENT (SHENZHEN) CO., LTD., Shenzhen (CN)

(72) Inventor: Bin Xu, Shenzhen (CN)

(73) Assignee: A&A INTELLIGENT (SHENZHEN) CO., LTD., Shenzhen (CN)

( * ) Notice: Subject to any disclaimer, the term of this patent is extended or adjusted under 35 U.S.C. 154(b) by 44 days.

(21) Appl. No.: 18/434,740

(22) Filed: Feb. 6, 2024

(65) Prior Publication Data

US 2024/0425244 A1 Dec. 26, 2024

(30) Foreign Application Priority Data

Jun. 20, 2023 (CN) ..... 202321593475.7

(51) Int. Cl.
*B65D 43/22* (2006.01)
*B65D 51/00* (2006.01)

(52) U.S. Cl.
CPC ..... *B65D 43/22* (2013.01); *B65D 51/00* (2013.01); *B65D 2251/1058* (2013.01)

(58) Field of Classification Search
CPC ..... E05C 17/50; E05B 7/0005; B65D 2251/1058; B65D 51/00; B65D 43/22
USPC ..... 206/315.14; 292/246
See application file for complete search history.

(56) References Cited

U.S. PATENT DOCUMENTS 1,184,439 A * 5/1916 Giles ..... E05C 17/50 292/DIG. 20
2,829,912 A * 4/1958 Koch ..... E05C 19/14 70/73
3,030,137 A * 4/1962 Tomkinson ..... E05C 19/14 292/113
4,540,206 A * 9/1985 Frame ..... E05C 19/14 292/DIG. 60
4,705,308 A * 11/1987 Bisbing ..... E05C 19/14 292/108
4,801,165 A * 1/1989 Pyle ..... E05C 19/14 292/249
5,271,649 A * 12/1993 Gromotka ..... E05C 19/14 292/DIG. 40
5,478,125 A * 12/1995 Gromotka ..... E05C 19/14 292/113
6,257,631 B1 * 7/2001 Sokurenko ..... E05C 19/14 292/DIG. 49
6,457,750 B1 * 10/2002 Sokurenko ..... E05C 19/14 292/113

(Continued)

*Primary Examiner* — Ernesto A Grano

(57) ABSTRACT

A lock catch structure and a storage box of chess pieces are provided. The lock catch structure includes a connecting buckle, a first fixing component, a lock cylinder, and a second fixing component. The connecting buckle is rotatably connected to the first fixing component, and the first fixing component is connected to a first end of a locked object. The lock cylinder is inserted into the second fixing component, and the second fixing component is connected to a second end of the locked object. The connecting buckle defines an accommodating cavity for accommodating the first fixing component and the second fixing component, the first fixing component and the second fixing component lock the first end of the locked object and the second end of the locked object.

10 Claims, 5 Drawing Sheets

(56) References Cited

U.S. PATENT DOCUMENTS

| | | | | |
|---|---|---|---|---|
| 7,017,955 | B1 * | 3/2006 | Chiang | E05C 19/14 292/113 |
| D548,565 | S * | 8/2007 | Vickers | D8/331 |
| 7,568,739 | B2 * | 8/2009 | Lee | B25H 3/02 292/85 |
| 7,654,589 | B2 * | 2/2010 | Vickers | E05B 13/002 292/DIG. 31 |
| 9,663,969 | B2 * | 5/2017 | Lila | E05B 17/0058 |
| 10,309,134 | B2 * | 6/2019 | Prehn | E05C 19/14 |
| 10,392,830 | B2 * | 8/2019 | Helsley | E05C 19/14 |
| D889,932 | S * | 7/2020 | Zeng | D8/331 |
| D900,588 | S * | 11/2020 | Rolfs | D8/331 |
| D993,743 | S * | 8/2023 | Zhou | D8/341 |
| 2012/0139296 | A1 * | 6/2012 | Wilkens | E05C 19/14 296/193.11 |
| 2014/0265367 | A1 * | 9/2014 | Lila | E05C 19/12 292/346 |

* cited by examiner

LOCK CATCH STRUCTURE AND STORAGE BOX OF CHESS PIECES

TECHNICAL FIELD

The present disclosure relates to a technical field of mechanical locks, and in particular to a lock catch structure and a storage box of chess pieces.

BACKGROUND

In the prior art, various types of mechanical locks are provided for locking doors, cases, cabinets, boxes, etc. Generally, structures of the various types of the mechanical locks are complex and require corresponding keys for unlocking, so that if there is an occasion just requiring a temporary lock, a temporary lock structure requiring a corresponding key for unlocking to avoid a locked object from being accidentally opened brings much inconvenience.

A storage box of chess pieces requires the temporary lock, after users finish chess, the chess pieces need to be stored in the storage box, in order to prevent the chess pieces stored in the storage box from losing, the storage box needs to be temporarily locked through a lock structure, so that the storage box is prevented from being accidentally opened. However, when a current storage box of chess pieces is locked, since there is a relatively large gap between a lock structure of the current storage box when the lock structure works to lock the current storage box, the lock structure is not stable, and after using for a long time, a locking function may be lost due to abrasion; if there is a relatively small gap between the lock structure of the current storage box when the lock structure works to lock the current storage box, after using for a long time, dust easily enters the lock structure to form dirt, so that the lock structure has much difficulty in working to lock the current storage box. Therefore, how to enable a lock catch structure to have stability for using for a long time and avoid the lock catch structure from entering the dust to cause locking difficulty is a problem to be solved.

SUMMARY

A first purpose of the present disclosure is to provide a lock catch structure for solving a technical problem about how to enable the lock catch structure to have stability for using for a long time and avoid the lock catch structure from entering the dust to cause locking difficulty.

In order to solve above technical problems, the lock catch structure is provided, including an upper catch assembly and a lower match assembly. The upper catch assembly includes a connecting buckle and a first fixing component, the connecting buckle is rotatably connected to the first fixing component, and the first fixing component is connected to a first end of a locked object. The lower match assembly includes a lock cylinder and a second fixing component, the lock cylinder is inserted into the second fixing component, and the second fixing component is connected to a second end of the locked object. The first fixing component includes a rotating portion and a connecting portion, the rotating portion is connected to the connecting buckle, and the connecting portion is disposed away from the rotating portion. The connecting buckle defines an accommodating cavity, the connecting buckle rotates with respect to the rotating portion, so as to accommodate the first fixing component and the second fixing component in the accommodating cavity, and the lock cylinder is inserted into the connecting portion, so that the first fixing component and the second fixing component lock the first end of the locked object and the second end of the locked object.

Furthermore, the connecting portion defines a lock hole, when the connecting portion is located in the accommodating cavity, the lock cylinder extends from the second fixing component into the lock hole.

Furthermore, the connecting buckle defines a positioning hole, the lock cylinder includes an inserting portion and a positioning portion, the positioning portion is disposed away from the inserting portion, the inserting portion is inserted into the lock hole, the positioning portion is inserted into the positioning hole, so as to lock the second fixing component to the connecting buckle with respect to the first fixing component.

Furthermore, the positioning portion includes a ball head, when the connecting buckle rotates with respect to the rotating portion, the ball head slides into the positioning hole of the connecting buckle.

Furthermore, the upper catch assembly further includes a cover plate, a first side surface and a second side surface are formed on two sides of the connecting buckle, the cover plate is disposed on the first side surface, and the accommodating cavity is defined between the cover plate and the second side surface, when the first fixing component or the second fixing component is accommodated in the accommodating cavity, one side of the first fixing component or one side of the second fixing component is in contact with the second side surface.

Furthermore, the cover plate is detachably connected to the connecting buckle, and the cover plate is capable of being detached from the first side surface.

Furthermore, the upper catch assembly further includes a rotating shaft, the rotating shaft passes through the rotating portion and the connecting buckle, the first fixing component includes a first bottom plate and a first protrusion protruding from the first bottom plate, the lock hole is defined on the first protrusion, when the connecting buckle rotates with respect to the rotating shaft to accommodate the first fixing component in the accommodating cavity, one side, close to the first protrusion, of the first bottom plate is in contact with the second side surface.

Furthermore, the second fixing component includes a second bottom plate and a second protrusion protruding from the second bottom plate, the lock cylinder passes through the second protrusion, when the connecting buckle rotates with respect to the rotating shaft to accommodate the second fixing component in the accommodating cavity, one side, close to the second protrusion, of the second bottom plate is in contact with the second side surface, and the lock cylinder is directly inserted into the lock hole.

A second purpose of the present disclosure is to provide a storage box of chess pieces for solving a technical problem about how to enable the storage box of the chess pieces to have stability for using for a long time and avoid a lock catch structure of the storage box of the chess pieces from entering the dust to cause locking difficulty.

In order to solve above technical problems, the storage box of the chess pieces is provided, including the lock catch structure as foregoing, a first frame plate, and a second frame plate. The upper catch assembly is detachably connected to the first frame plate, and the lower match assembly is detachably connected to the second frame plate.

Furthermore, the first frame plate and the second plate are overlapped to form a storage cavity for storing the chess pieces, where the first fixing component and the second fixing component lock the first frame plate and the second frame plate.

Embodiments of the present disclosure have following beneficial effects.

In a first embodiment, the lock catch structure is provided, when the connecting buckle rotates with respect to the rotating portion, the first fixing component and the second fixing component are accommodated in the accommodating cavity, and the lock cylinder is inserted into the connecting portion, so that the first fixing component and the second fixing component lock the locked object. In this way, stability enabling the lock catch structure to be used for a long time is improved and a problem in the prior art that stability of a current lock catch may be reduced after a long-term use is solved.

In a second embodiment, the storage box of the chess pieces is provided, the storage box of the chess pieces includes the lock catch structure provided in the first embodiment, the first frame plate, and the second frame plate. The upper catch assembly is detachably connected to the first frame plate, and the lower match assembly is detachably connected to the second frame plate. In this way, the first fixing component and the second fixing component lock the first frame plate and the second frame plate, thereby preventing the first frame plate and the second frame plate from being accidentally opened and further preventing the chess pieces stored in the storage cavity from losing.

BRIEF DESCRIPTION OF DRAWINGS

In order to more clearly illustrate embodiments of the present disclosure or technical solutions in the prior art, drawings that need to be used in the embodiments or the prior art are briefly described below, and it is obvious that accompanying drawings in following description are merely some embodiments of the present disclosure, and those who skilled in the art may obtain other drawings according to these drawings without involving any inventive effort.

Figure 1:
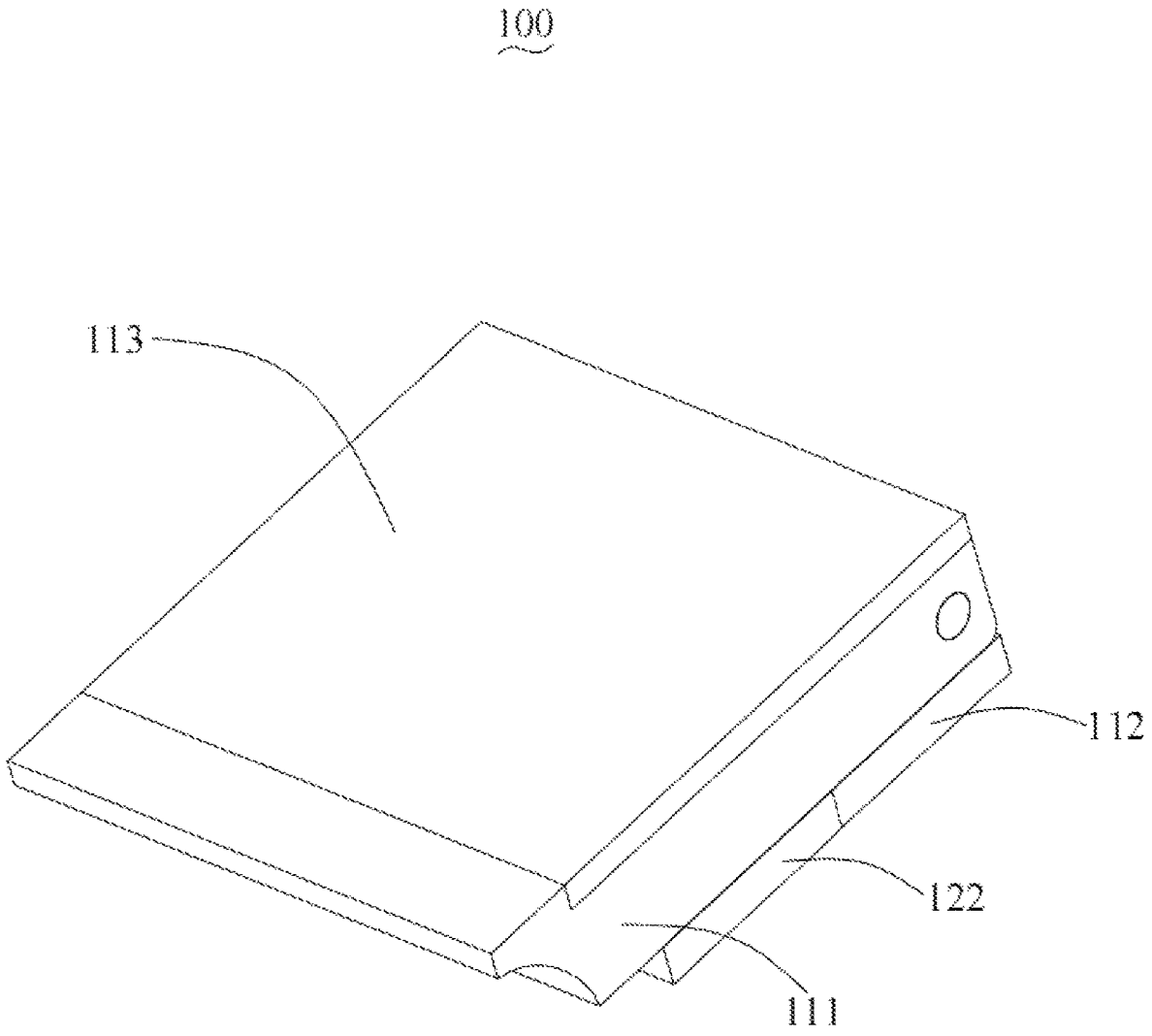
FIG. 1 is a schematic diagram of a lock catch structure presented in a first angle according to a first embodiment of the present disclosure.

Reference numerals in the drawings: 100, lock catch structure; 110, upper catch assembly; 111, connecting buckle; 1111, accommodating cavity; 1112, positioning hole; 1113, first side surface; 1114, second side surface; 112, first fixing component; 1121, rotating portion; 1122, connecting portion; 11221, lock hole; 1123, first bottom plate; 1124, first protrusion; 113, cover plate; 114, rotating shaft; 120, lower match assembly; 121, lock cylinder; 1211, inserting portion; 1212, positioning portion; 122, second fixing component; 1221, second bottom plate; 1222, second protrusion; 200, storage box of chess pieces; 210, first frame plate; 220, second frame plate; 230, storage cavity.

DETAILED DESCRIPTION

In order to facilitate understanding of the present disclosure, the present disclosure is described more fully hereinafter with reference to accompanying drawings. Preferred embodiments of the present disclosure are given in the accompanying drawings. However, the present disclosure may be implemented in many different forms and is not limited to embodiments described herein. On the contrary, a purpose of providing these embodiments is to make the understanding of a content of the present disclosure more thorough and comprehensive.

It should be noted that when an element is referred to as being "fixed to" another element, it may be directly on another element or intermediate elements may also be provided. When an element is considered to be "connected to" another element, it may be directly connected to another element or intermediate elements may also be provided. Terms "vertical", "horizontal", "left", "right", etc. used herein are for illustrative purposes only.

Unless otherwise defined, all technical and scientific terms used herein have the same meaning as commonly understood by those who skilled in the art of the present disclosure. A terminology used herein in the specification of the present disclosure is for a purpose of describing particular embodiments only and is not intended to limit the present disclosure. As used herein, a term "and/or" includes any and all combinations of one or more of associated listed items.

First Embodiment

Please refer to FIGS. 1-7, the first embodiment of the present disclosure provides a lock catch structure 100, including an upper catch assembly 110 and a lower match assembly 120. The upper catch assembly 110 includes a connecting buckle 111 and a first fixing component 112, the connecting buckle 111 is rotatably connected to the first fixing component 112, and the first fixing component 112 is connected to a first end of a locked object. The lower match assembly 120 includes a lock cylinder 121 and a second fixing component 122, the lock cylinder 121 is inserted into the second fixing component 122, and the second fixing component 122 is connected to a second end of the locked object. The first fixing component 112 includes a rotating portion 1121 and a connecting portion 1122, the rotating portion 1121 is connected to the connecting buckle 111, and the connecting portion 1122 is disposed away from the rotating portion 1121. The connecting buckle 111 defines an accommodating cavity 1111, the connecting buckle 111 rotates with respect to the rotating portion 1121, so as to accommodate the first fixing component 112 and the second fixing component 122 in the accommodating cavity 1111, and the lock cylinder 121 is inserted into the connecting portion 122, so that the first fixing component 112 and the second fixing component 112 lock the first end of the locked object and the second end of the locked object. In the specific application, when the connecting buckle 111 rotates with respect to the rotating portion 1121, the connecting portion 1122 of the first fixing component 112 is gradually accommodated in the accommodating cavity 1111, and in this process, since the connecting portion 1122 is disposed away from the rotating portion 1121, when the connecting buckle 111 rotates with respect to the rotating portion 1121, a part, close to the rotating portion 1121, of the first fixing component 112 is first accommodated in the accommodating cavity 1111, and then the accommodating cavity 1111 gradually accommodates the connecting portion 1122, when the connecting portion 1122 starts to be gradually accommodated into the accommodating cavity 1111, the second fixing component 122 abuts against the connecting portion 1122 to accommodate into the accommodating cavity 230 along with the connecting portion 1122, when the first fixing component 112 and the second fixing component 122 are completely accommodated into the accommodating cavity 1111, the lock cylinder 121 passing through the second fixing component 122 is inserted into the connecting portion 1122, since the first fixing component 112 is connected to the first end of the locked object, the second fixing component 122 is connected to the second end of the locked object, the first fixing component 112 and the second fixing component 122 lock the first end of the locked component and the second of the locked component to complete temporary locking. In this way, the lock catch structure 100 quickly and reliably locks the locked object temporarily.

In one implementation, the connecting portion 1122 defines a lock hole 11221, when the connecting portion 1122 is located in the accommodating cavity 1111, the lock cylinder 121 extends from the second fixing component 122 into the lock hole 11221. In specific application, in order to improve stability of the lock catch structure 100 after working to lock, the lock hole 11221 is defined on the connecting portion 1122, when the connecting portion 1122 starts to enter the accommodating cavity 1111, the lock cylinder 121 passing through the second fixing component 122 starts to engage with the lock hole 11221, so that when the connecting portion 1122 of the first fixing component 112 is completely accommodated into the accommodating cavity 1111, the first fixing component 112 is fastened with the second fixing component 122, so that the locked object is avoided from being accidentally opened.

In one implementation, the connecting buckle 111 defines a positioning hole 1112, the lock cylinder 121 includes an inserting portion 1211 and a positioning portion 1212, the positioning portion 1212 is disposed away from the inserting portion 1211, the inserting portion 1211 is inserted into the lock hole 11221, the positioning portion 1212 is inserted into the positioning hole 1112, so as to lock the second fixing component 122 to the connecting buckle 111 with respect to the first fixing component 112. In specific application, since the lock cylinder 121 includes the inserting portion 1211 and the positioning portion 1212, the inserting portion 1211 is configured to insert into the lock hole 11221, and the positioning portion 1212 is configured to insert into the positioning hole 1112, and when the second fixing component 122 enters the accommodating cavity 1111, the positioning hole 1112 is formed on the connecting buckle 111 corresponding to the positioning portion 1212, so that the positioning portion 1212 is inserted into the positioning hole 1112. In this way, the first fixing component 112 is fastened to the connecting buckle 111, so that the second fixing component 122 is locked on the connecting buckle 111 with respect to the first fixing component 112.

In one implementation, the positioning portion 1212 includes a ball head (not shown in the drawings), when the connecting buckle 111 rotates with respect to the rotating portion 1121, the ball head slides into the positioning hole 1112 of the connecting buckle 111. In specific application, in order to easily abut the first fixing component 112 against the connecting buckle 111, when the connecting buckle 111 is in contact with the positioning portion 1212, the ball head of the positioning portion 1212 slides into the positioning hole 1112 of the connecting buckle 111. In this way, through using the ball head to be in contact with the connecting buckle 111, a contact area between the positioning portion 1212 and the connecting buckle 111 is reduced, so that the first fixing component 112 easily abuts against the connecting buckle 111.

In one implementation, the upper catch assembly 110 further includes a cover plate 113, a first side surface 1113, and a second side surface 1114 are formed on two sides of the connecting buckle 111, the cover plate 113 is disposed on the first side surface 1113, and the accommodating cavity 1111 is defined between the cover plate 113 and the second side surface 1114, when the first fixing component 112 or the second fixing component 122 is accommodated in the accommodating cavity 1111, one side of the first fixing component 112 or one side of the second fixing component 122 is in contact with the second side surface 1114. In specific application, since the cover plate 113 covers the first side surface 1113, the accommodating cavity 1111 is formed between the cover plate 113 and the second side surface 1114, and a fastening position of the first fixing component 112 and the second fixing component 122 are located in the accommodating cavity 1111, the cover plate 113 blocks dust in air, so that the dust in the air cannot enter the accommodating cavity 1111. In this way, a cooperation gap between the first fixing component 112 and the second fixing component 122 are prevented from accumulating dust to form dirt to affect fluency of fastening. In addition, when the first fixing component 112 or the second fixing component 122 is accommodated in the accommodating cavity 1111, the one side of the first fixing component 112 or the one side of the second fixing component 122 is in contact with the second side surface 1114, the dust is also well prevented from entering the accommodating cavity 1111.

In one implementation, the cover plate 113 is detachably connected to the connecting buckle 111, and the cover plate 113 is capable of being detached from the first side surface 1113. In specific application, the cover plate 113 is detachably connected to the connecting buckle 111, so that the cover plate 113 is capable of being replaced, different patterns are printed or engraved on one side, facing away from the accommodating cavity 1111, of the cover plate 113 to improve ornamental value or attractiveness of the lock catch structure 100, and in addition, the cover plate 113 is detached from the first side surface 1113 through fasteners, so that the fasteners are prevented from being exposed on the one side, facing away from the accommodating cavity 1111, of the cover plate 113 to affect the attractiveness of the lock catch structure 100.

In one implementation, the upper catch assembly 110 further includes a rotating shaft 114, the rotating shaft 114 passes through the rotating portion 1121 and the connecting buckle 111, the first fixing component 112 includes a first bottom plate 1123 and a first protrusion 1124 protruding from the first bottom plate 1123, the lock hole 11221 is defined on the first protrusion 124, when the connecting buckle 111 rotates with respect to the rotating shaft 114 to accommodate the first fixing component 112 in the accommodating cavity, one side, close to the first protrusion 1124, of the first bottom plate 1123 is in contact with the second side surface 1114. In specific application, when the connecting buckle 111 rotates with respect the rotating shaft 114 to enable the first fixing component 112 to be accommodated in the accommodating cavity 1111, the one side, close to the first protrusion 1124, of the first bottom plate 1123 is in contact with the second side surface 1114, so that the lock hole 11221 of the first protrusion 1124 arrives a predetermined position through contact and cooperation between the one side, close to the first protrusion 1124, of the first bottom plate 1123 and the second side surface 1114.

In one implementation, the second fixing component 112 includes a second bottom plate 1221 and a second protrusion 1222 protruding from the second bottom plate 1221, the lock cylinder 121 passes through the second protrusion 1222, when the connecting buckle 111 rotates with respect to the rotating shaft 114 to accommodate the second fixing component 122 in the accommodating cavity 1111, one side, close to the second protrusion 1222, of the second bottom plate 1221 is in contact with the second side surface 1114, and the lock cylinder 121 is directly inserted into the lock hole 11221. In specific application, when the connecting buckle 111 rotates with respect to the rotating shaft 114 to enable the second fixing component 122 to be accommodated in the accommodating cavity 1111, the one side, close to the second protrusion 1222, of the second bottom plate 1221 is in contact with the second side surface 1114, so that the lock cylinder 121 passing through the second protrusion 1222 arrives the same position as the lock hole 11221 through contact and cooperation between the one side, close to the second protrusion 1222, of the second bottom plate 1221 and the second side surface 1114, so that the lock cylinder 121 is directly inserted into the lock hole 11221, thereby improving docking precision of locking.

Second Embodiment

The second embodiment is different from the subject matter set forth in the first embodiment. Details can be referred to following.

Figure 2:
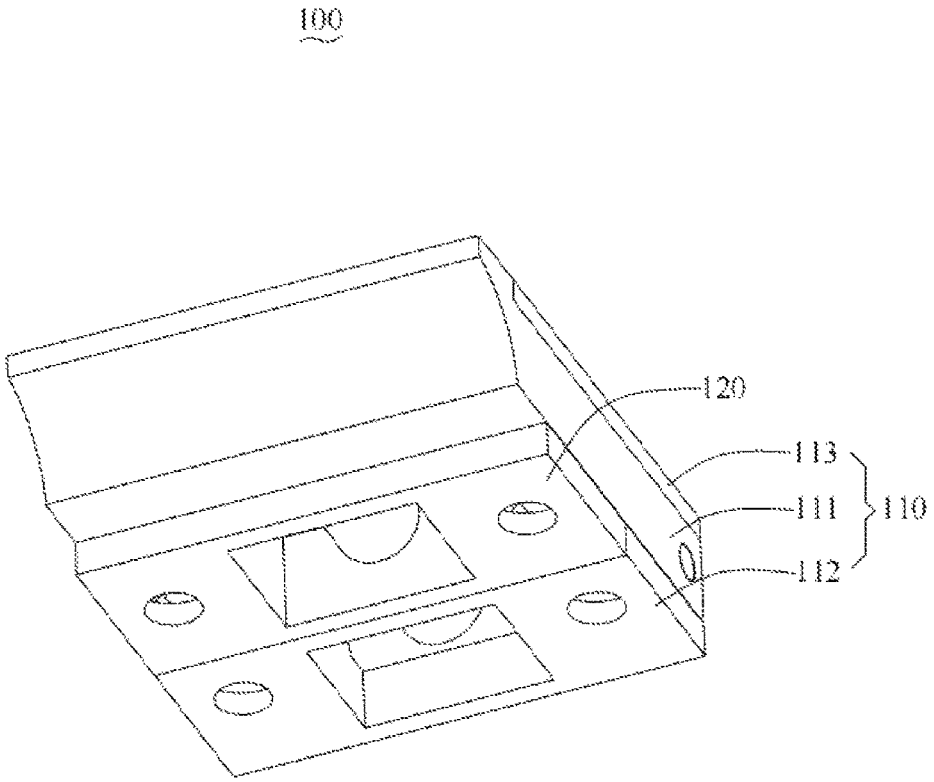
FIG. 2 is a schematic diagram of the lock catch structure presented in a second angle according to the first embodiment of the present disclosure.
Figure 3:
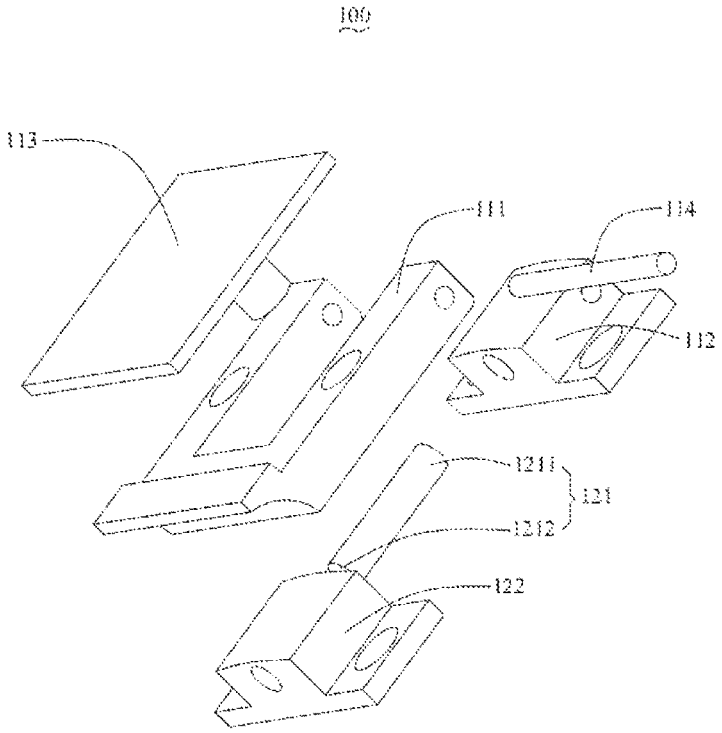
FIG. 3 is an exploded schematic diagram of the lock catch structure according to the first embodiment of the present disclosure.
Figure 4:
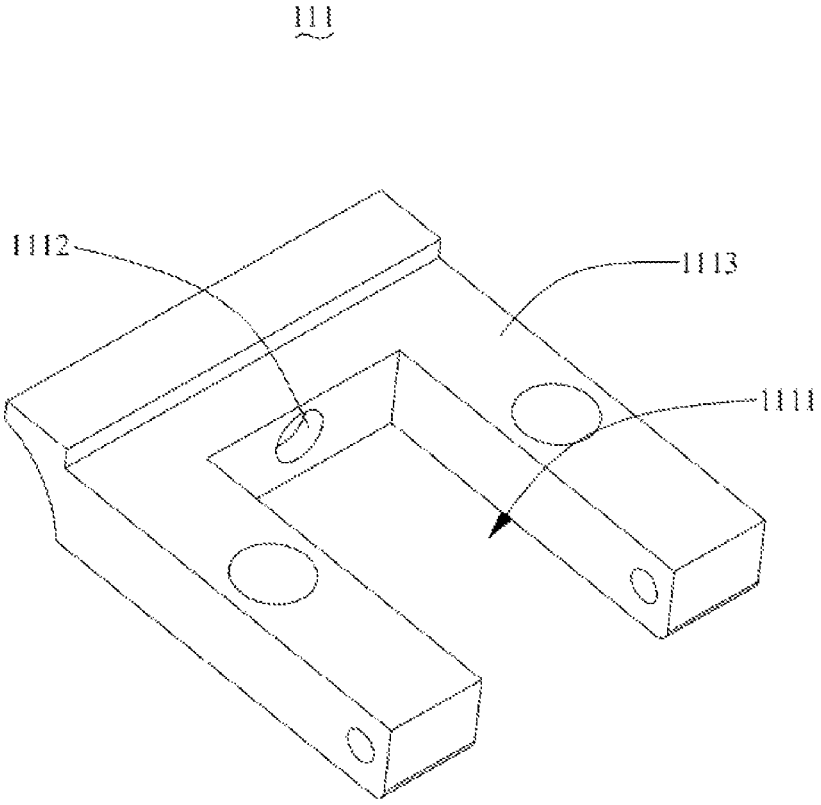
FIG. 4 is a schematic diagram of a connecting buckle presented in a first angle according to the first embodiment of the present disclosure.
Figure 5:
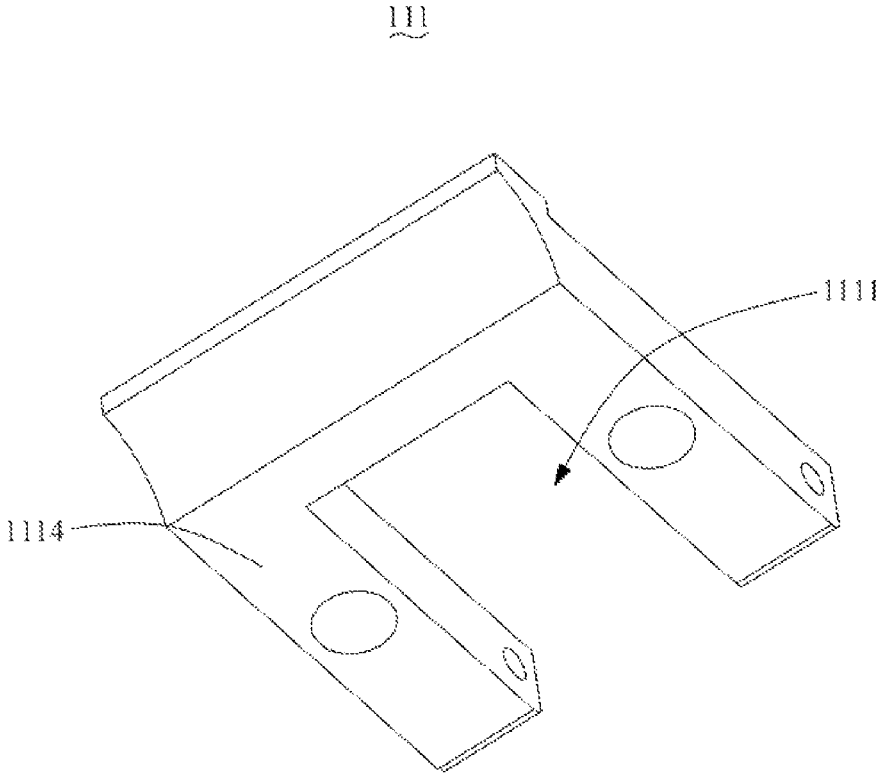
FIG. 5 is a schematic diagram of the connecting buckle presented in a second angle according to the first embodiment of the present disclosure.
Figure 6:
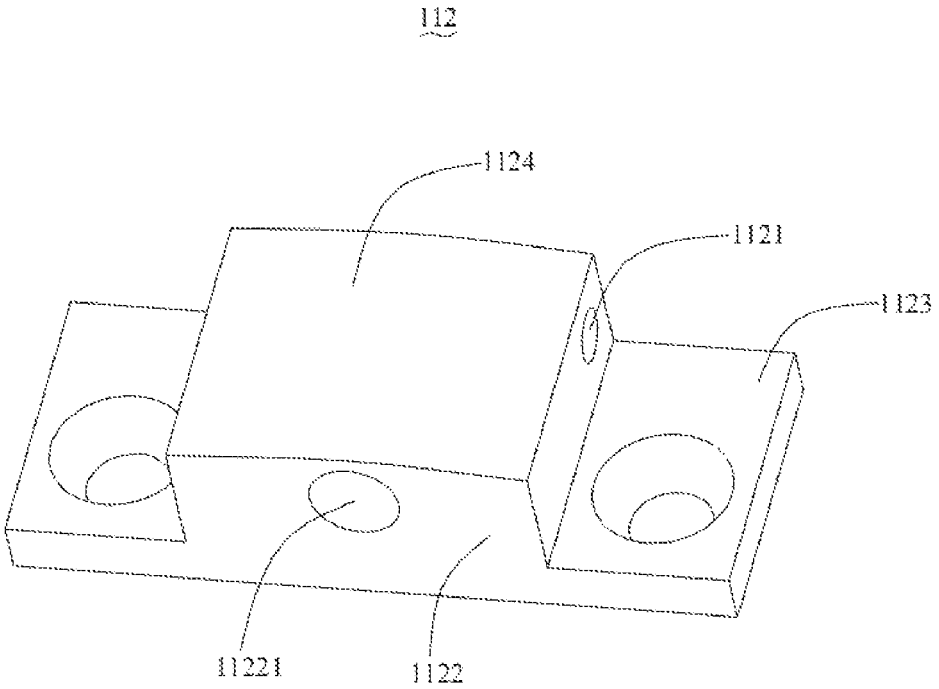
FIG. 6 is a structural schematic diagram of a first fixing component according the first embodiment of the present disclosure.
Figure 7:
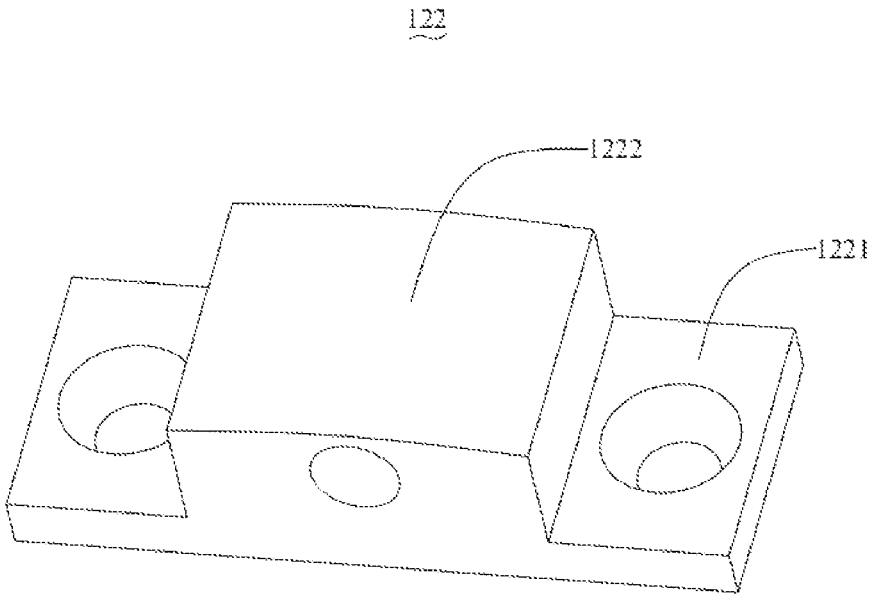
FIG. 7 is a structural schematic diagram of a second fixing component according to the first embodiment of the present disclosure.
Figure 8:
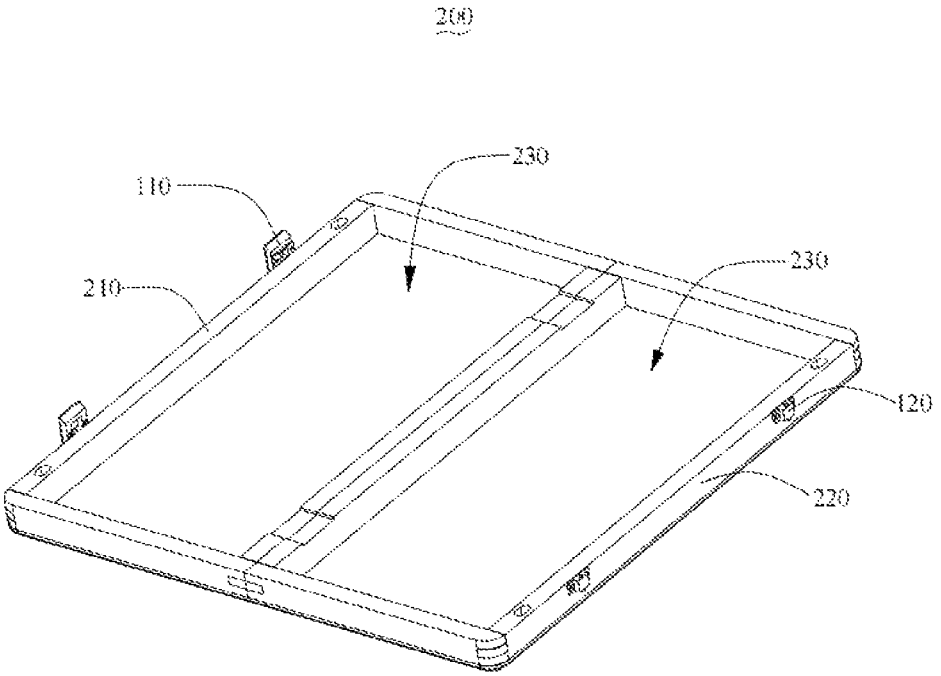
FIG. 8 is a structural schematic diagram of a storage box of chess pieces according a second embodiment of the present disclosure.

Please refer to FIGS. 1, 2, and 8, the second embodiment of the present disclosure provides a storage box 200 of chess pieces, including the lock catch structure 100, a first frame plate 210, and a second frame plate 220. The upper catch assembly 110 is detachably connected to the first frame plate 210, and the lower match assembly 120 is detachably connected to the second frame plate 220. In specific application, the first fixing component 112 of the upper catch assembly 110 is detachably connected to the first frame plate 210, and the second fixing component 122 of the lower match assembly 120 is detachably connected to the second frame plate 220, thereby improving convenience of assembling the storage box 200 for the chess pieces with the lock catch structure 100.

In one implementation, the first frame plate 210 and the second plate 220 are overlapped to form a storage cavity 230 for storing the chess pieces, where the first fixing component 112 and the second fixing component 122 lock the first frame plate 210 and the second frame plate 220. In specific application, the first frame plate 210 and the second plate 220 are overlapped to form the storage cavity 230 for storing the chess pieces, where the first fixing component 112 and the second fixing component 122 lock the first frame plate 210 and the second frame plate 220, since the lock catch structure 100 is capable of temporarily locking the storage box 200 for the chess pieces through the first fixing component 112 and the second fixing component 122, the first frame plate 210 and the second frame plate 220 of the storage box 200 for the chess pieces are avoided from being accidentally separated, causing the chess pieces therein to accidentally drop from the storage cavity 230. When the chess pieces in the storage box 200 of the chess pieces need to be taken out, only the connecting buckle 111 needs to be pried to rotate with respect the first fixing component 112, so that the first fixing component 112 and the second fixing component 122 are separated, and the first frame plate 210 and the second frame plate 220 are opened to take out the chess pieces in the storage box 200 of the chess pieces. Therefore, using the lock catch structure 100 provided by the present disclosure in the storage box 200 of the chess pieces may improve stability when locking the lock catch structure 100 and convenience when unlocking the lock catch structure 100.

Above embodiments only express several embodiments of the present disclosure, and description thereof is more specific and detailed, but cannot be understood as a limitation on a protection scope of the present disclosure. It should be noted that, for those who skilled in the art, several variations and improvements may be made without departing from a concept of the present disclosure, and these are all within the protection scope of the present disclosure. Therefore, the protection scope of the present disclosure shall be subject to the appended claims.

What is claimed is:

1. A lock catch structure, comprising:

an upper catch assembly; and a lower match assembly;

wherein the upper catch assembly comprises a connecting buckle and a first fixing component, the connecting buckle is rotatably connected to the first fixing component, and the first fixing component is connected to a first end of a locked object; the lower match assembly comprises a lock cylinder and a second fixing component, the lock cylinder is inserted into the second fixing component, and the second fixing component is connected to a second end of the locked object; the first fixing component comprises a rotating portion and a connecting portion, the rotating portion is connected to the connecting buckle, and the connecting portion is disposed away from the rotating portion; the connecting buckle defines an accommodating cavity, the connecting buckle rotates with respect to the rotating portion, so as to accommodate the first fixing component and the second fixing component in the accommodating cavity, and the lock cylinder is inserted into the connecting portion, so that the first fixing component and the second fixing component lock the first end of the locked object and the second end of the locked object.

2. The lock catch structure according to claim 1, wherein the connecting portion defines a lock hole, when the connecting portion is located in the accommodating cavity, the lock cylinder extends from the second fixing component into the lock hole.

3. The lock catch structure according to claim 2, wherein the connecting buckle defines a positioning hole, the lock cylinder comprises an inserting portion and a positioning portion, the positioning portion is disposed away from the inserting portion, the inserting portion is inserted into the lock hole, the positioning portion is inserted into the positioning hole, so as to lock the second fixing component to the connecting buckle with respect to the first fixing component.

4. The lock catch structure according to claim 3, wherein the positioning portion comprises a ball head, when the connecting buckle rotates with respect to the rotating portion, the ball head slides into the positioning hole of the connecting buckle.

5. The lock catch structure according to claim 2, wherein the upper catch assembly further comprises a cover plate, a first side surface and a second side surface are formed on two sides of the connecting buckle, the cover plate is disposed on the first side surface, and the accommodating cavity is defined between the cover plate and the second side surface, when the first fixing component or the second fixing component is accommodated in the accommodating cavity, one side of the first fixing component or one side of the second fixing component is in contact with the second side surface.

6. The lock catch structure according to claim 5, wherein the cover plate is detachably connected to the connecting buckle, and the cover plate is capable of being detached from the first side surface.

7. The lock catch structure according to claim 5, wherein the upper catch assembly further comprises a rotating shaft, the rotating shaft passes through the rotating portion and the connecting buckle, the first fixing component comprises a first bottom plate and a first protrusion protruding from the first bottom plate, the lock hole is defined on the first protrusion, when the connecting buckle rotates with respect to the rotating shaft to accommodate the first fixing component in the accommodating cavity, one side, close to the first protrusion, of the first bottom plate is in contact with the second side surface.

8. The lock catch structure according to claim 7, wherein the second fixing component comprises a second bottom plate and a second protrusion protruding from the second bottom plate, the lock cylinder passes through the second protrusion, when the connecting buckle rotates with respect to the rotating shaft to accommodate the second fixing component in the accommodating cavity, one side, close to the second protrusion, of the second bottom plate is in contact with the second side surface, and the lock cylinder is directly inserted into the lock hole.

9. A storage box of chess pieces, comprising:

the lock catch structure according to claim 1;

a first frame plate; and a second frame plate;

wherein the upper catch assembly is detachably connected to the first frame plate, and the lower match assembly is detachably connected to the second frame plate.

10. The storage box of the chess pieces according to claim 9, wherein the first frame plate and the second plate are overlapped to form a storage cavity for storing the chess pieces, where the first fixing component and the second fixing component lock the first frame plate and the second frame plate.

* * * * *